United States Patent [19]

Martin

[11] 4,098,387

[45] Jul. 4, 1978

[54] ADJUSTABLE COUNTERWEIGHT FOR ONE-ARMED COIN CRADLE

[75] Inventor: Bart G. Martin, St. Louis, Mo.

[73] Assignee: Coin Acceptors, Inc., St. Louis, Mo.

[21] Appl. No.: 742,601

[22] Filed: Nov. 17, 1976

[51] Int. Cl.[2] ..... G07F 3/04

[52] U.S. Cl. ..... 194/102

[58] Field of Search ..... 194/99, 102, 103; 177/191, 206, 249, 250, 216, 126, 246

[56] References Cited

U.S. PATENT DOCUMENTS

| | | | |
|---|---|---|---|
| 424,593 | 4/1890 | Batdorf | 194/103 |
| 1,045,425 | 11/1912 | Millward | 177/126 |
| 1,072,589 | 9/1913 | Duquette | 177/206 |
| 3,590,971 | 7/1971 | Stewart | 194/103 |

*Primary Examiner*—Stanley H. Tollberg
*Attorney, Agent, or Firm*—Cohn, Powell & Hind

[57] ABSTRACT

A coin testing apparatus having a cradle pivotally mounted on a frame about a pivot axis, the cradle including an arm at one side of the pivot axis. A shoulder is fixed to the frame and is spaced from the cradle arm for carrying a true value coin on and between the cradle arm and shoulder when the cradle arm is in an initial position. The shoulder is spaced from the cradle arm for passing the true value coin between the cradle arm and shoulder and to the coin passageway when the cradle is moved to a delivery position. A counterweight is adjustably mounted on the cradle at the other side of the pivot axis for varying the location of the counterweight selectively from the pivot axis to counterbalance the weight of the true value coin so that the true value coin will be moved by the cradle from the initial position to the delivery position at a predetermined momentum, but a coin of different weight carried on and between the cardle arm and shoulder will be moved at a different momentum. With the adjustable counterweight, the coin weight can be detected. The counterweight can be selectively adjusted so that a coin of lesser weight than the true value coin will not move the cradle to the delivery position and will be lodged between the cradle arm and shoulder. The counterweight includes a reduced portion that is located in a channel formed in the cradle and extending radially outward from the pivot axis, and includes an enlarged head portion located outwardly of the cradle channel for digital access for selectively moving the counterweight in the channel.

3 Claims, 6 Drawing Figures

ADJUSTABLE COUNTERWEIGHT FOR ONE-ARMED COIN CRADLE

BACKGROUND OF THE INVENTION

This invention relates generally to an improved one-armed coin cradle, and more particularly to a device of this type that has an adjustable counterweight for allowing field and test adjustment for detecting coin weight.

In the heretofore conventional one-armed cradle utilized in coin-accepting devices, the main purpose was to detect the coin size. A coin of a lesser size than the true value coin would fall between the cradle arm and the fixed frame shoulder and into a coin rejection passageway. An oversized coin of sufficient weight would engage the cradle arm and the frame shoulder, and pivot the cradle to a position in which the frame shoulder would cam the spurious coin off of the cradle arm and into the coin rejection passageway. However, if a spurious coin of acceptable size, but of different weight than the true value coin, was caught between the cradle arm and frame shoulder, such spurious coin could move the cradle and be discharged into the coin acceptance passageway.

SUMMARY OF THE INVENTION

The present one-armed coin cradle performs the same tests for size as the heretofore conventional one-armed cradle discussed previously. However, this one-armed cradle also detects differences in coin weights so that only a coin of acceptable size and weight will be accepted.

In the coin-testing apparatus, the one-armed cradle is pivotally mounted on a frame means about a pivot axis, the cradle having an arm at one side of the pivot axis. A shoulder is fixed to the frame means and is spaced from the cradle arm for carrying a true value coin on and between the cradle arm and shoulder when the cradle is in an initial position, and is spaced from the cradle arm for passing the true value coin between the cradle arm and shoulder and to the coin passageway when the cradle is moved to a delivery position. A counterweight is adjustably mounted on the cradle at the other side of the pivot axis for varying the location of the counterweight selectively from the pivot axis to counterbalance the weight of the true value coin so that the true value coin will be moved by the cradle from the initial position to the delivery position at a predetermined momentum, but a coin of different weight carrried on and between the cradle arm and shoulder will be moved at a different momentum. Adjusting the location of the counterweight permits the coin momentum to be changed depending upon the coin weight. This feature permits a coin of lesser weight than the true value coin to have its momentum actually stopped while carried by the cradle arm and shoulder or allows a spurious coin of proper size but of different weight to be delivered into the coin acceptance passageway by the cradle but at a different momentum than the true value coin, whereby the coin path can then be changed by the action of a magnetic field acting on the coin and sensing the coin momentum.

As suggested, the counterweight can be adjustably positioned on the cradle to counterbalance the weight of the true value coin so that the true value coin will move the cradle from the initial position to the delivery position, but a coin of lesser weight will not move the cradle to the delivery position and will be lodged between the cradle arm and shoulder until removed by a suitable scavenging means.

The counterweight-mounting means provided on the cradle includes a channel in the cradle extending generally outward from the pivot axis, the counterweight being slidably mounted in the channel for selectively locating the counterweight at different positions in the channel.

More particularly, the channel in the cradle extends radially outward from the pivot axis, and the counterweight includes a reduced portion located in the channel, and slidably and frictionally engaging the cradle, and includes an enlarged head portion located outwardly of the cradle channel for digital access incident to selectively moving the counterweight in the channel.

DESCRIPTION OF THE PREFERRED EMBODIMENT

Figure 1:
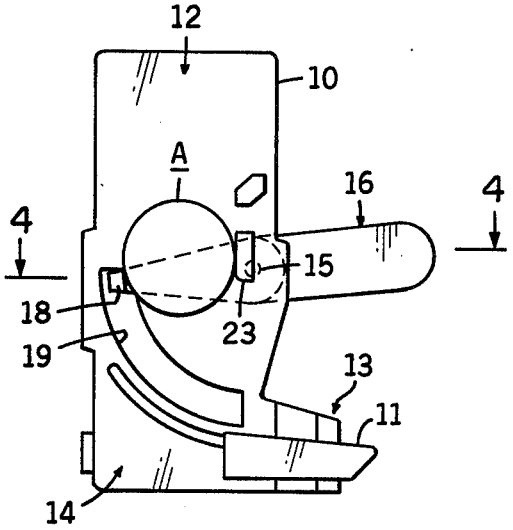
FIG. 1 is a front elevational view of the apparatus with the cradle located in its initial position.

Referring now by characters of reference to the drawing, it will be understood that the coin-accepting device includes a frame means including a base plate 10 having a rail 11, the frame means defining a coin entrance passageway 12, a coin acceptance passageway 13 and a coin rejection passageway 14.

Pivotally mounted on the frame 10 by a pivot pin 15 is a cradle 16, the pivot pin 15 defining a pivot axis. The cradle portion 17 at one side of the pivot axis is provided with a forwardly projecting arm 18 that extends through an arcuate slot 19 formed in the frame 10. As will be understood from later detailed description of parts, the cradle arm 18 is adapted to engage and assist in holding a coin moving through the device.

The cradle portion 20 at the other side of the pivot axis 15 is provided with an elongate channel 21 extending radially outward from the pivot axis. The channel 21 is defined by lateral side margins 22 on the cradle portion 20.

Fixed to the front portion of the frame 10 is a shoulder 23, the shoulder 23 being spaced from the cradle arm 18 and cooperating with the cradle arm 18 in holding and testing a coin lodged therebetween.

Figure 6:
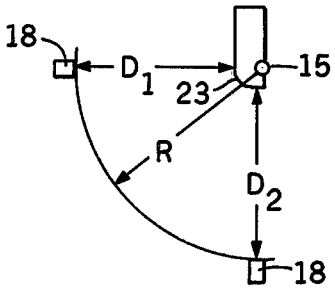
FIG. 6 is a diagrammatic view illustrating the important dimensions between the cradle arm and fixed frame shoulder at the initial and delivery positions of the cradle.

As will be understood from the diagrammatic view in FIG. 6, the radius of rotation of the cradle arm 18 about the pivot axis defined by a pivot pin 15 is represented by reference character R. The effective distance between the cradle arm 18 and the shoulder 23 when the cradle 16 is located in its initial position is represented character D1. The distance D1 closely approximates, but is slightly less than the diameter of the true value coin A shown in FIG. 1 so that such coin A engages and is held between the cradle arm 18 and shoulder 23.

However, the shoulder 23 is dimensioned so that the distance between the cradle arm 18 and the shoulder 23 when the cradle 16 is located in its delivery position is represented by reference character D2. The distance D2 is slightly greater than the diameter of the true value coin A so that such coin A can pass between the cradle arm 18 and the shoulder 23 and into the coin acceptance passageway 13, as is best shown in FIG. 3.

A counterweight 24 is adjustably mounted on the cradle portion 20. The counterweight 24 includes a reduced portion 25 that is slidably located in the cradle channel 21 and frictionally engages the lateral cradle margins 22 of such channel 21 to hold the counterweight 24 in any selected adjusted position. The counterweight 24 also includes an enlarged head portion 26 that is located outwardly of the cradle channel 21 for digital access to facilitate moving the counterweight 24 selectively in the channel 21.

Figure 2:
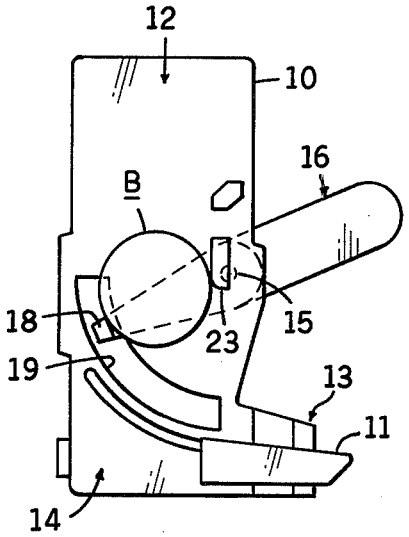
FIG. 2 is a front elevational view, similar to FIG. 1, but showing the cradle slightly rotated from its initial position.
Figure 3:
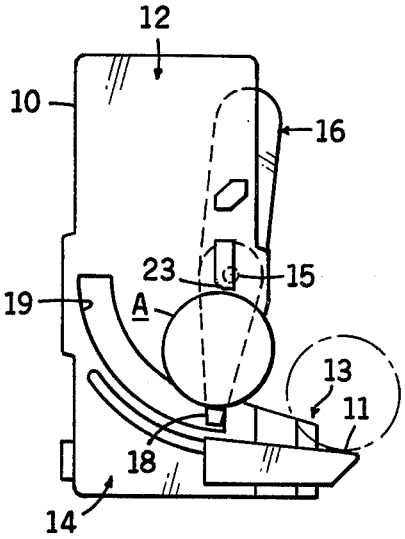
FIG. 3 is a front elevational view similar to FIGS. 1–2, but showing the cradle rotated to its delivery position.
Figure 4:
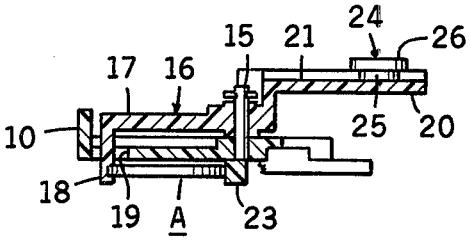
FIG. 4 is a cross-sectional view taken on line 4—4 of FIG. 1.
Figure 5:
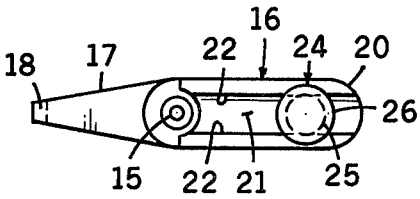
FIG. 5 is a rear elevational view of the cradle.

The counterweight 24 is adjustably mounted on the cradle 16 for varying the location of the counterweight 24 selectively from the pivot axis to counterbalance the weight of the true value coin so that the true value coin will be moved by the cradle 16 from the initial position of FIG. 1 to the delivery position of FIG. 3 at a predetermined momentum, but that a coin of different weight carried on and between the cradle arm 18 and shoulder 23 will be moved at a different momentum. In fact, it is possible for an adjustment to be made of the counterweight position so that a coin of lesser weight will not move the cradle 16 to the delivery position but will be lodged between the cradle arm 18 and shoulder 23 as illustrated in FIG. 2 until removed by a suitable scavenging means.

When a true value coin A enters the coin entrance passageway 12, the coin A will engage and be carried between the cradle arm 18 and shoulder 23 as shown in FIG. 1. The weight of the true value coin A will rotate the cradle 16 about the pivot axis to the delivery position shown in FIG. 3. In this delivery position of the cradle 16, the true value coin will pass between the cradle arm 18 and shoulder 23 and will pass to the coin acceptance passageway 13 as shown in broken lines in FIG. 3.

A spurious coin that closely approximates the same diameter size of the true value coin, but being of lighter weight will also enter the coin entrance passageway 12 and will engage and be carried between the cradle arm 18 and shoulder 23 as shown in FIG. 1. However, the counterweight 24 can be selectively adjusted to a position in the cradle channel 21 so that such a spurious coin will rotate the cradle 16 at a different momentum than that realized by a true value coin. When the cradle 16 is so moved to the delivery position of FIG. 3, the spurious coin being of approximately the same diameter size as the true value coin, will pass between the cradle arm 18 and shoulder 23 and pass to the coin acceptance passageway, but at a different momentum, As a result, the path of the spurious coin can then be subsequently changed by the action of a magnetic field as provided by a permanent magnet as is well-known in this field. The momentum of a coin moving through a magnetic field will determine the path the coin takes, i.e., a true value coin moving through the magnetic field at a predetermined momentum will move toward an acceptance passageway while a spurious coin moving at a different momentum through the magnetic field will be directed toward a rejection passageway.

Further, the counterweight 24 can be selectively positioned in the cradle channel 21 so that the spurious coin B carried by and between the cradle arm 18 and shoulder 23 will not have sufficient weight to rotate the cradle 16 fully to the delivery position of FIG. 3 but rather will rotate the cradle 16 only slightly as is shown in FIG. 2. In this instance, the spurious coin B will be lodged between the cradle leg 18 and shoulder 23 until it is cleared by a suitable scavenging means as is well known in the art.

If a spurious coin that is over-sized enters the coin entrance passageway 12, it will engage and be carried between the cradle arm 18 and shoulder 23. If the spurious coin has sufficient weight, it will rotate the cradle 16 toward and to the delivery position shown in FIG. 3. However, because the spurious coin is over-sized, it cannot pass between the cradle leg 18 and shoulder 23. On the contrary, because the spurious coin is over-sized, the shoulder 23 will simply cam the over-sized spurious coin off of the cradle leg 18 and into the coin rejection passageway 14.

It will be understood that this one-armed cradle also allows an undersized spurious coin to fall between the cradle arm 18 and shoulder 23 when the cradle 16 is in the initial position shown in FIG. 1. This undersized spurious coin will then fall directly to the coin rejection passageway 14 without effectively rotating the cradle 16.

I claim as my invention:

1. In a coin testing apparatus for detecting both coin size and weight:

(a) a frame means defining a coin passageway, (b) a cradle pivotally mounted on the frame means about a pivot axis, the cradle including an arm at one side of the pivot axis, (c) a shoulder fixed to the frame means and spaced from the cradle arm a first predetermined distance slightly less than the diameter of a true value coin for carrying a coin having the diameter of a true value coin on and between the cradle arm and shoulder when the cradle is in an initial position, and spaced from the cradle arm a second predetermined distance slightly greater than the diameter of the true value coin for passing the coin having the diameter of the true value coin between the cradle arm and shoulder and to the coin passageway when the cradle is moved to a delivery position, so that only a coin of proper size is passed to the coin passageway, and (d) a counterweight adjustably mounted on the cradle at the other side of the pivot axis for varying the location of the counterweight selectively from the pivot axis to counterbalance the weight of the true value coin so that the true value coin will move the cradle from the initial position to the delivery position and be delivered to the coin passageway at a predetermined momentum but a coin of proper size but of different weight carried on and between the cradle arm and shoulder will have a different momentum.

2. A coin testing apparatus as defined in claim 1, in which:

(e) counterweight-mounting means includes:

(1) a channel in the cradle extending generally outward from the said other side of the pivot axis, and (2) the counterweight being slidably mounted in the channel and frictionally engaging the cradle in the channel for selectively locating and holding the counterweight at different locations in the channel during roataion of the cradle.

3. A coin testing apparatus as defined in claim 1, in which:

(e) counterweight-mounting means includes:

(1) a channel in the cradle extending radially outward from the said other side of the pivot axis, and (2) the counterweight includes a reduced portion located in the channel and slidably and frictionally engaging the cradle in the channel, and an enlarged head portion located outwardly of the cradle channel and at one side of the cradle for digital access incident to selectively moving the counterweight in the channel.

* * * * *